US008534022B2

(12) United States Patent
Bromer

(10) Patent No.: US 8,534,022 B2
(45) Date of Patent: Sep. 17, 2013

(54) TWISTED THREADED REINFORCING BAR

(75) Inventor: Nicholas Sheppard Bromer, Marietta, PA (US)

(73) Assignee: Empire Technology Development, LLC, Wilmington, DE (US)

( * ) Notice: Subject to any disclaimer, the term of this patent is extended or adjusted under 35 U.S.C. 154(b) by 120 days.

(21) Appl. No.: 13/139,328

(22) PCT Filed: Jan. 17, 2011

(86) PCT No.: PCT/US2011/021463

§ 371 (c)(1),
(2), (4) Date: Jun. 13, 2011

(87) PCT Pub. No.: WO2012/099570

PCT Pub. Date: Jul. 26, 2012

(65) Prior Publication Data

US 2012/0180426 A1 Jul. 19, 2012

(51) Int. Cl.

| | |
|---|---|
| ***E04B 2/00*** | (2006.01) |
| ***E04B 1/00*** | (2006.01) |
| ***E04G 21/00*** | (2006.01) |
| ***E04G 23/00*** | (2006.01) |
| *E04C 3/00* | (2006.01) |
| *F16B 39/30* | (2006.01) |
| *F16B 35/04* | (2006.01) |
| *B21H 3/02* | (2006.01) |
| *B21D 49/00* | (2006.01) |
| *B21K 23/00* | (2006.01) |
| *B23P 17/00* | (2006.01) |

(52) U.S. Cl.
USPC ..... 52/583.1; 52/849; 52/742.1; 52/745.19; 411/307; 411/415; 470/8; 29/897.34

(58) Field of Classification Search
USPC ..... 52/223.1, 223.6, 223.14, 583.1, 831, 52/849, 742.1, 745.19; 411/307, 415; 470/8–10; 29/897.34
See application file for complete search history.

(56) References Cited

U.S. PATENT DOCUMENTS

| | | | | | |
|---|---|---|---|---|---|
| 3,710,526 | A | * | 1/1973 | Parks | 52/223.6 |
| 3,850,535 | A | * | 11/1974 | Howlett et al. | 403/305 |
| 4,842,464 | A | | 6/1989 | Green | |
| 5,678,373 | A | * | 10/1997 | Franklin et al. | 52/439 |
| 5,924,254 | A | * | 7/1999 | Franklin et al. | 52/439 |
| 5,954,456 | A | * | 9/1999 | Bowles | 405/259.6 |
| 6,009,677 | A | | 1/2000 | Anderson | |

(Continued)

OTHER PUBLICATIONS

Popov, Introduction to Mechanics of Solids, 1968, pp. 130-132, pp. 181-182, Prentice Hall, Inc., Englewood Cliffs, NJ, USA.

(Continued)

*Primary Examiner* — Andrew Triggs
(74) *Attorney, Agent, or Firm* — Turk IP Law, LLC

(57) ABSTRACT

Techniques for reinforcing concrete using rebar are disclosed. Some example embodiments may include prestressed concrete structures reinforced by twisted, threaded reinforcing bars. An example reinforcing bar for a prestressed concrete structure may include an elongated, generally cylindrical rod; an external thread disposed on the generally cylindrical rod, the external thread formed from an elongated, generally nonlinear channel wrapped about a radial surface of the generally cylindrical rod in a generally helical fashion. A base portion of the nonlinear channel may be disposed substantially against the radial surface of the generally cylindrical rod and/or an upstanding portion of the nonlinear channel may extend generally orthogonally from the radial surface of the generally cylindrical rod.

11 Claims, 9 Drawing Sheets

(56) References Cited

U.S. PATENT DOCUMENTS

| | | | | |
|---|---|---|---|---|
| 6,098,357 | A * | 8/2000 | Franklin et al. | 52/223.7 |
| 6,619,888 | B2 * | 9/2003 | Calandra et al. | 405/259.6 |
| 6,773,198 | B2 * | 8/2004 | Copping | 403/313 |
| 2002/0088315 | A1 * | 7/2002 | Thurman et al. | 81/176.15 |
| 2007/0175167 | A1 * | 8/2007 | Allen et al. | 52/726.1 |
| 2008/0229683 | A1 | 9/2008 | Bystricky et al. | |
| 2008/0261042 | A1 | 10/2008 | Brandstrom | |
| 2008/0273941 | A1 | 11/2008 | Van Cor | |
| 2009/0178590 | A1 | 7/2009 | Mitchell et al. | |
| 2009/0217616 | A1 | 9/2009 | Ennis et al. | |

OTHER PUBLICATIONS

Crigler, John, Post-Tensioning Revisited, Structure Magazine, 2007, http://www.structural.net/Article/tabid/434/contentid/194/Default.aspx—date retrieved Nov. 30, 2010.

Williams Form Engineering Corp., Grade 75 All-Thread Rebar web page—http://www.wiliiamsform.com/Threaded Bars/Grade 75 AllThread_Rebar/grade_75_all-,thread_rebar.html—date retrieved Nov. 30, 2010..

DSI Ground Support, DYWIDAG Threadbar web page, http://www.dsigroundsupport.com/products/dywidagthreadbar/all-thread-rebar.html—date retrieved Nov. 30, 2010.

Wire Rope Engineering Handbook, USS Tiger Brand Wire Rope Engineering Handbook, by United States Steel, http://www.slideruleera.netjmiscellaneous.html—date retrieved Nov. 30, 2010.

Static Models of Elasticity and Poisson's Ration of Concrete, Univ. of New Mexico, Civil Engineering Department, http://civilx.unm.edu/laboratories_ssjpccjmodulusofE.html—date retrieved Nov. 30, 2011.

Little, et al, Fungal Influenced Corrosion in Post-Tension Structures, The Electrochemical Society Interface, 2001, pp. 44-48. http://www.electrochem.org/dl/interface/wtr/wtrOI/IF12-OI-Pages44-48.pdf—date retrieved Nov. 30, 2011.

http://www.spsrepair.com/ContractingServices/ConcreteStructuraIRepa ir/PostTensionedConcrete/tabid/462/Default.aspx—date retrieved Nov. 30, 2010.

http://www.construction-resource.com/forum/archive/index.php/t-1278.html—date retrieved Nov. 30, 2011.

Taper Threaded Rebar Splicing Systems, Lenton on-line Catalog, http://www.erico.com/public/library/Concrete/LT0426.pdf—date retrieved Nov. 30, 2011.

Allred, Bryan, Post-Tensioned Slabs, Journal of Light Construction, 2004, 7 pp., www.jIconline.com, USA.

http://cee.engr.ucdavis.edu/faculty/kunnath/eci135/eci135-ho1.pdf—date retrieved Nov. 30, 2011.

Catalog page, dated Sep. 9, 2007.

International Search Report and Written Opinion from PCT/US2011/021463 issued Apr. 20, 2011.

* cited by examiner

TWISTED THREADED REINFORCING BAR

CROSS-REFERENCE TO RELATED APPLICATIONS

This application is a national stage entry of PCT/US2011/021463, filed Jan. 17, 2011, which is hereby incorporated by reference.

BACKGROUND

The present disclosure contemplates that reinforced concrete structures may be prestressed using "post-tension" methods and/or "pre-tension" methods. Post-tension reinforcement of concrete may create compressive forces in a concrete beam and/or plate that may be cast on-site, such as a floor of an office building or a beam of a bridge. For example, in post-tension reinforcement, concrete may be poured over greased cables that may be sheathed in plastic tubing. Although the plastic tubing may become adhered to the concrete, the grease may allow the cables to slide within the tubing. After the concrete cures, special machines and/or fixtures may be used to pull on protruding cable ends, creating tension, and/or to fix the cable ends in position while maintaining the tension on the cables. Thus, the cables may exert compressive forces on the concrete.

The present disclosure contemplates that in some pre-tension methods, a solid reinforcing bar ("rebar") may be held in tension while concrete is poured and/or cures around the rebar. Once the concrete has cured, the externally applied tension on the rebar may be released, thereby allowing the rebar to apply compressive stresses to the concrete. Due to the difficulties of stretching rebar on-site, this method may be performed in a factory.

As used herein, "stress" may refer to a measure of the internal forces acting within a deformable body. As used herein, "strain" may refer to the deformation of a physical body under the action of applied forces.

The present disclosure contemplates that post-tensioning with cables may not be as effective for increasing the strength of concrete members as cast-in-place pre-tensioned rebar. The difference may be at least partially because compressive stress produced by a post-tension cable may not be applied evenly throughout the concrete (e.g., along the length of the cable), but instead may be applied substantially at the cable ends (e.g., on the outer surface of the concrete where the cables terminate). A post-tension cable, sliding in a greased tube, may not apply substantial forces inside the concrete structure (except, if the cable is curved, it may apply lateral forces generally at right angles to the cable). In contrast, a pre-tension rebar may apply forces to the concrete along the length of the rebar.

SUMMARY

Techniques for reinforcement of concrete using one or more reinforcement bars are generally disclosed. Some example embodiments may include prestressed concrete structures reinforced by twisted, threaded reinforcing bars.

In some example embodiments, a reinforcing bar for a prestressed concrete structure is generally described that may include an elongated, generally cylindrical rod and an external thread disposed on the rod. The external thread may be formed from an elongated, generally nonlinear channel wrapped about a radial surface of the generally cylindrical rod in a generally helical fashion. A base portion of the nonlinear channel may be disposed substantially against the radial surface of the generally cylindrical rod and an upstanding portion of the nonlinear channel may extend generally orthogonally from the radial surface of the generally cylindrical rod.

In some additional embodiments, prestressed concrete structures are generally described that may include a hardened concrete body, a reinforcing bar extending at least partially through the hardened concrete body and including a threaded section engaged with the hardened concrete body and a first lock configured to maintain the reinforcing bar in a twisted condition so that the threaded section maintains an axial compressive force on the hardened concrete body. The first lock may be arranged to oppose rotation of a locked section of the reinforcing bar relative to the hardened concrete body.

Methods of constructing prestressed concrete structures are generally described. Some example methods may include torsionally stressing a reinforcing bar such that an external reinforcing bar thread engaged with a hardened concrete body applies a compressive force to the hardened concrete body. Some example methods may further include securing the torsionally stressed reinforcing bar to maintain its torsional stress. In some example methods, the compressive force may be applied to the hardened concrete body in a generally axial direction relative to the reinforcing bar.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

In the drawings.

DETAILED DESCRIPTION

Figure 1A:
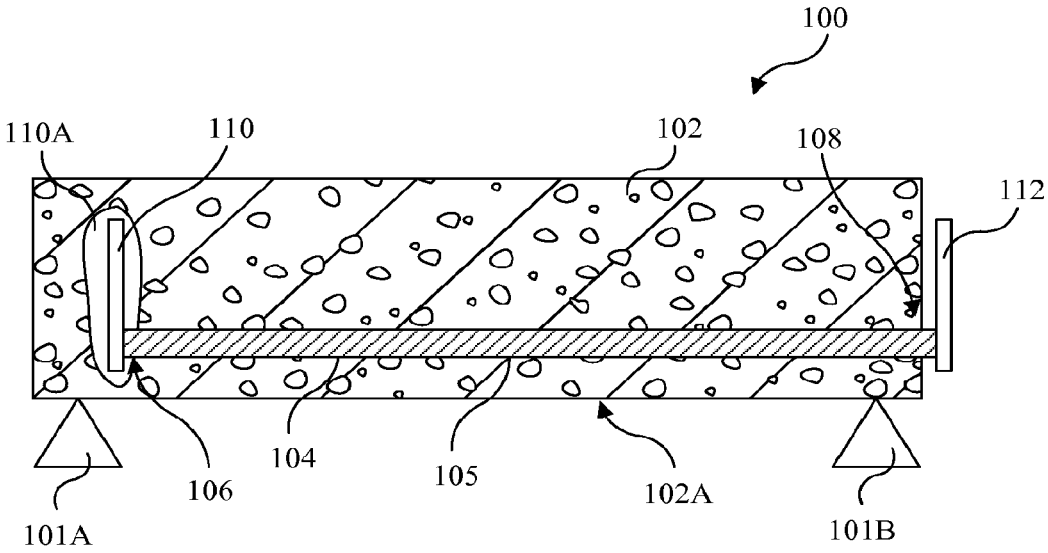
FIG. 1A is a cross-sectional view of an example prestressed concrete beam.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the Figures, may be arranged, substituted, combined, and designed in a wide variety of different configurations, all of which are explicitly contemplated and make part of this disclosure.

This disclosure is drawn, inter alia, to methods, systems, devices, and/or apparatus related to reinforcement of concrete using one or more reinforcement bars ("rebar"). Some example embodiments may include prestressed concrete structures reinforced by twisted, threaded rebar.

The present disclosure contemplates that when forces are applied against opposing points at the two ends of a beam, the stress may be concentrated at the points of application; however, the stress may not remain concentrated throughout the beam length. Toward the middle of the beam, the stress produced by the end forces may be distributed nearly uniformly over the area of the transverse beam cross-section. At any particular beam transverse cross-section, the integral of the compressive pressure over the cross-sectional area may be substantially equal to the force applied at the ends, but the distribution of the pressure may vary from high pressure over a small area (at the end faces) to low pressure over substantially the entire area (near the middle of the beam).

The present disclosure contemplates that this redistribution of force may occur according to Saint-Venant's principle of rapid dissipation of localized stresses. According to Saint-Venant's principle, a localized force may dissipate into a substantially uniform pressure at a distance from the application point that is about equal to the width of the member. As mentioned above, a post-tensioned cable may apply forces directly to the beam at two end points. Regardless of where the force is applied on the end faces, near the middle of the beam the compression force may be spread substantially evenly across the beam's cross-section.

The present disclosure contemplates that the situation may be different with prestressed construction, where the rebar may be locked to the concrete by the rebar's surface indentations. Because the rebar may be locked to the concrete along the length of the rebar, the stress may not spread out in the same manner, but, instead, may remain substantially concentrated near the rebar. Inside the beam, the force applied by the rebar may not result in any appreciable strain of the concrete, because contraction may be resisted by the entire beam and there may be much more concrete than steel. When the pretension on the rebar is released at the factory, the beam may not contract appreciably. The rebar, being locked to the concrete, may also not contract appreciably. (Some dimpling might take place at the beam ends, but any effect from that may not be felt in the middle, again due to Saint-Venant's principle.)

The present disclosure contemplates that because there may be substantially no strain near the middle portion of the beam, there may also be substantially no Saint-Venant's principle stress dissipation there. Consider a small cubical element of the beam, near the rebar, that is aligned to the major axes of the beam. The force from the rebar may be generally axial, and that force may be transferred from the element face which is perpendicular to the beam length onto the adjoining face of the next element, and so on along the length of the beam. The force may not be transferred to a laterally-adjoining element unless there is some strain. The adjoining element by itself may not generate any force; instead, if it is deformed, stress may be induced in that adjoining element.

The present disclosure contemplates that this effect may be understood by imagining a rectangular pile of children's cubical blocks (which may be analogous to the elements mentioned above), where the blocks are stacked in a regular Cartesian array on the floor, so that each face of each block is in full contact with a corresponding face of an adjoining block (except on the outside of the pile). Imagine further that the pile is in contact with a vertical wall, and that a force is exerted on one block in the middle of the pile opposite the wall, with the force directed toward the wall. Pressing on the one block may transfer the applied force directly to the wall through a horizontal column of blocks, and the wall may be subjected to force only there (e.g., substantially no dissipation of the force). If the wall is immovable, then the blocks may not substantially change their positions (e.g., there may be substantially zero strain). Next, imagine that the wall is yielding and that the blocks arc glued with a yielding adhesive, such as rubber cement. Now, the horizontal column may move forward and the blocks in the adjoining horizontal columns may also move, spreading out the force according to Saint-Venant's principle. Finally, imagine that the blocks are glued together but wall is again unyielding. Since none of the blocks move, the force may not spread, even though the rubber cement connects the blocks. Essentially, this example may demonstrate that with minimal strain there may also be minimal stress dissipation.

The present disclosure contemplates that another analogy may be useful for understanding stress dissipation. The stress induced by the pre-tensioned rebar may be somewhat like the compressive stress that may be produced by a pipe carrying chilled fluid, which was located in the same position as the rebar. The concrete around the pipe may experience stress due to thermal contraction, but it may not actually contract in the axial direction because the stress in the chilled core may be counteracted by opposing stresses in the other portions. By the principles of statics, the integral of the stress over any transverse cross-section of the beam must be zero (because there is no external force in this example), so the stress in the chilled portion would result in an opposing stress in the rest of the beam, with net force zero. By symmetry, this may happen all along the beam (except the ends) and the contractive stress would remain localized. The beam may contract only very slightly if the chilled core were a small fraction of the entire cross-section. That stress can exist without a corresponding strain may be exemplified by the type of auto glass which is tempered to have permanent tensile strain in the outer layers. When broken, the embedded stress causes the glass to shatter into pebbles, rendering it harmless in an accident.

The present disclosure contemplates that another example may be useful for understanding stress dissipation as described above. Take an ordinary rectangular gum-rubber eraser, draw parallel lines across the wider side face with a pen, and stand it end-up on a table. If the upstanding end is compressed with a flat object held parallel to the tabletop, the lines may remain straight. If the upstanding end is compressed with a pencil held parallel to the tabletop and transverse to the lined face, the lines near the pencil may bend (this can be seen by looking at the lines nearly end-on). In the case of the flat object, the compressive force may be transmitted without any strain (except for the vertical direction), and there may be substantially no dissipation. In the second case involving the pencil, dissipation of stress according to Saint-Venant's principle may be related to strain other than just axial strain.

The present disclosure contemplates that the above discussion may be summarized as follows. Compressive forces applied by a pre-tensioned rebar may remain near the rebar, but the forces applied by a post-tensioned cable may not remain near the cable. Also, a post-tensioned cable's force may be applied substantially evenly over the entire cross-section of the beam, except near the ends.

The present disclosure contemplates that if a beam that is suspended at both ends is loaded, for example by a weight near the middle of the beam, the beam may be subjected to bending (flexure). The bending of the beam may be resisted by compression in the upper portion of the beam and by tension in the lower portion of the beam. These compressive and tensile forces which resist bending may be greater near the middle of the length of the beam. Considering the beam's transverse cross section, at the beam's "neutral axis" there may be neither compression nor tension, and the compression may increase linearly to a maximum at the upper surface while the tension may increase to a maximum at the lower surface.

The present disclosure contemplates that because concrete may be relatively strong in compression but may be relatively weak in tension, rebar may be placed in the lowermost portion of a concrete beam so as to resist the tensile force which may occur there.

The present disclosure contemplates that, according to Saint-Venant's principle, a post-tensioned cable may create substantially the same force at the top of the beam and at the middle of the beam as at the bottom. Therefore, most of the force exerted by the cable may be "wasted," doing little or nothing to resist bending and thereby stiffen the beam. The pressure in the upper portion, above the neutral axis, may actually make the beam more likely to fail in compression by pre-loading the upper portion the "wrong" way (e.g., instead of opposing the bending induced compressive forces in the upper portion of the beam, the post-tension forces may further increase the compressive forces felt in the upper portion of the beam). In the lower portion of the beam, the effectiveness of the force may decrease from the lower surface toward the neutral axis and may be only partially effective. For example, if the beam has a rectangular cross section, then the force in the lower portion may be about one-half effective, and the compressive force for the whole beam may be about one-quarter effective. Thus, the steel in the cable may be being used at about 25% efficiency.

The present disclosure contemplates that, in contrast to post-tension cables, pre-tensioned rebar located in the lowermost portion of the beam may be very efficient because the force it exerts may be substantially confined to, and utilized in, the "right" portion of the beam, namely, where the tension loading in the beam may be counteracted.

The present disclosure contemplates that although a beam is discussed above, the same ideas may apply to floors, plates, or other structures. Also, besides the "unbonded" system of greased cables described above, there may also be a "bonded" post-tension system in which ducts may be embedded in the concrete. After the concrete cures, cables may be fished through the ducts, tensioned, and then grouted in place to lock in the applied tension. The bonded cables may have generally the same the stress distribution characteristics as the unbonded cables described above. The tension in the concrete due to tightening the cable ends may be generally the same in both cases. Grouting may preserve, without changing, the stress distribution.

The present disclosure contemplates that it may be beneficial to provide the higher structural efficiency of pre-stressed solid rebar but in a post-cure application that may provide at least some of the implementation advantages of post-tensioned cable. Some example embodiments according to the present disclosure may include post-tensioned rebar that produces substantially the same force distribution in hardened concrete as factory-made, pre-tensioned rebar. In some example embodiments, the rebar may be cast in concrete at the construction site and/or may not require curing the concrete while the rebar remains strained (e.g., the rebar may be strained after the concrete cures).

FIG. 1A is a cross-sectional view of an example concrete beam 100, arranged in accordance with at least some embodiments of the present disclosure. As depicted, beam 100 may be supported by supports 101A, 101B. Beam 100 may include a hardened concrete body 102 at least partway through which a threaded rebar 104 may extend. For example, threaded rebar 104 may extend within the lower portion 102A of the hardened concrete body 102, generally where the hardened concrete body 102 may experience tensile stress due to bending. External threads (for example, as discussed below) of threaded rebar 104 may threadedly engage corresponding internal threads of hardened concrete body 102, which may be formed by concrete cured around the external threads of threaded rebar 104. A lubricant 105 may at least partially interpose threaded rebar 104 and hardened concrete body 102.

Threaded rebar 104 may include a first end 106 and/or a second end 108. First end 106 may be fixed within hardened concrete body 102, such as by an internal wrench 110. In some example embodiments, internal wrench 110 may be disposed within a cavity 110A formed in the hardened concrete body 102. Second end 108 may extend externally of hardened concrete body 102. An external wrench 112 may be coupled to second end 108. As discussed below, external wrench 112 may be used to torsionally deform threaded rebar 104 to prestress hardened concrete body 102. In some example embodiments, first end 106 may extend externally of hardened concrete body 102 and/or may include a corresponding external wrench generally similar to external wrench 112.

Some example embodiments according to the present disclosure may utilize "all-thread" rebar, which may be commercially available in various diameters and/or lengths. All-thread rebar may be much like the "threaded rod" found in hardware stores and/or may include a substantially continuous thread along its length. The threads of this type of rebar may mate with external nuts and/or may lock the rebar to the concrete.

In some example embodiments, lubricant 105 may remain effective after concrete 102 has set around it. For example, lubricant 105 may include one or more strips of heavily-greased paper disposed around the outside surface of threaded rebar 104. In some example embodiments, the strips of greased paper may fit rebar 104 closely and/or substantially without gaps, thereby avoiding adhesion of rebar 104 to concrete 102. In some example embodiments, rebar 104 may be rotated back and forth slightly while concrete 102 is curing to help prevent adhesion. Some example embodiments utilizing rotation to prevent adhesion may not utilize greased paper strips. In some example embodiments, the gap between rebar 104 and concrete 102 may be minimized, which may provide a closer fit and/or improved contact between rebar 104 and concrete 102.

In some example embodiments, cavity 110A may be formed in the hardened concrete body 102 by embedding a form, which may be generally similar to a plastic bottle, for example, in the liquid concrete with the internal wrench 110 inside the form. Cavity 110A may allow the internal wrench 110 to dither, to a limited extent, inside the cavity when external wrench 112 is rotated back and forth (e.g., during curing as discussed above). Cavity 110A may act as a reservoir for lubricant as discussed below.

In some example embodiments, internal wrench 110 may be configured to prevent and/or limit rotation of first end 106 of rebar 104. Internal wrench 110 may include, for example, a metal cross piece welded to first end 106 of rebar 104. Alternatively, internal wrench 110 may engage rebar 104 generally as an open-end or box-end wrench engages the head of a bolt. For example, a multiple number of flats may be formed on first end 106 of rebar 104 and/or a component generally similar to an open-end and/or box-end wrench may be engaged with the flats. In some example embodiments, the internal wrench 110 may be held in position by concrete 102; however, rebar 104, which may be lubricated, may be able to rotate relative to the concrete, starting from a position near the internal wrench.

In some example embodiments, second end 108 of rebar 104 may protrude from concrete 102. After concrete 102 has cured, second end 108 may be rotated, such as by external wrench 112. An example external wrench 112 may be an actual wrench (e.g., an off-the-shelf tool) and/or may include any device capable of exerting torque on second end 108 of rebar 104.

Torque applied to second end 108 of rebar 104 may cause rebar 104 to twist (e.g., torsionally deform), which may also have the effect of advancing the threads of rebar 104 relative to corresponding female threads cast into the concrete 102, which may have molded themselves on the threads of rebar 104 during cure. Neglecting friction, the degree of twist of rebar 104 at any point along the length of rebar 104 may be approximately proportional to the distance from first end 106. Thus, as discussed below, the advance of the threads of rebar 104 through concrete 102 may also be generally proportional to the distance from first end 106. The torque may be applied in the direction that will stretch rebar 104 and/or compress concrete 102 (e.g., counter-clockwise for right-handed threads).

Stated concisely, in some example embodiments, applying a torque to external wrench 112 may cause rebar 104 to rotate due to torsional deformation; rebar 104 may move relative to the concrete female threads, thereby forcing second end 108 outward; rebar 104 may become longer, may be stressed, and may transfer a generally axial force to the adjacent concrete through the female threads; and the compressive force may be substantially uniform along the length of rebar 104. The effect may be generally the same as that of factory-made, pre-tensioned rebar if external wrench 112 is kept fixed in position to maintain the torque. The efficiency may be increased several times in comparison with post-tensioned cable because the stress may remain substantially localized in the portion of the beam that resists tension.

In some example embodiments, use of solid rebar 104 may provide a stiffer reinforcement than would be provided by tensioned cable. The present disclosure contemplates that due to the low proportion of cross-sectional area of steel (as opposed to air) in a cable and/or the decreased modulus of elasticity because the cable can stretch by winding itself more tightly, the modulus of cable may be substantially less than that of solid rod. For example, a one-inch cable may have an actual cross-sectional area between about 0.380 and about 0.580 square inches, while a solid rod of the same diameter may have an area of about 0.785 square inches. Considering the median value of 0.480, the area of the cable is only about 60% that of the rod. The moduli of steel cable may be roughly half the modulus of solid steel of the same diameter. Thus, the overall modulus for cable may be only about a third of the modulus for rebar of the same diameter. The present disclosure contemplates that a difference in stiffness may become significant if a reinforced concrete structure is loaded enough to neutralize the prestress and/or the steel reinforcement begins to stretch. For example, in some such circumstances, a lack of stiffness may cause beam failure.

The following analysis assumes that concrete is incompressible. A rod may have a twist $\phi$ (per unit of length) that may be given by $$\phi = T/JG$$

where T may be torque, J may be the moment of inertia, and/or G may be the modulus of elasticity in shear. For a circular rod, J may be given by $\frac{1}{2}\pi r^4$, where r may be the radius of the rod.

Substituting yields $$\phi = 2T/G\pi r^4$$

where $\phi$ may be in radians. The axial advance of the screw of the all-thread rebar may be equal to the thread pitch p times the number of revolutions of the rebar. Since one revolution may be equal to $2\pi$ radians, the axial advance z of the rebar threads for an angle $\phi$ may be $z = p\phi 2\pi$.

Combining the last two equations yields $$z = pT/[G(\pi r^2)^2]$$

or, $$z = pT/[GA^2],$$

where A may be the cross-sectional area of the rebar core (excluding threads), i.e., $\pi r^2$.

The elongation of a rod, per unit of length, due to an axial force may be $$\epsilon = \sigma/E$$

where $\sigma$ may be the axial stress and/or E may be the modulus of elasticity in tension. For steel, the modulus of elasticity in tension (E) may be about 30 million psi, while the modulus of elasticity in shear (G) may be about 12 million psi. E may be expressed as 2.5 G and the last equation may be rewritten as $$\epsilon = \sigma(2.5)G.$$

The force F in the rebar may be equal to $\sigma A$. Realizing that $z = \epsilon$, equating, and simplifying yields $$F = (2.5)pT/A, \text{ or (since } A = \pi r^2), F = (0.8)pT/r^2.$$

This equation shows that the amount of concrete compression F may decrease as the square of the radius of the rebar. Rebar that is 3½ inches in diameter may exert about 23 times less compressive force than rebar that is inch in diameter, for the same torque. The force may be proportional to the pitch of the threads, so rebar of high pitch may be useful in larger diameters.

The modulus of elasticity of concrete may be about 4.26 million psi, which may be about 7 times less than the modulus of steel. If a one inch radius steel rod is compressing a 2.8 inch radius concrete cylinder (with a cross section seven times as that of the rod), the compression strain of one may substantially equal the elongation of the other. As discussed above, a concrete "core" may not substantially contract in length relative to the rest of a beam because of shear strain, so the compressive force may be resisted by substantially the entire beam, the beam may not contract appreciably, and there may be substantially no internal strain, only internal stress.

In some example embodiments, rebar 104 may be vibrated while the torque is being applied (or afterward) to free localized small hang-ups due to thread irregularities or dirt. The vibration may be applied axially (or otherwise) and/or may use various frequencies. An alternative may be to hit second end 108 of rebar 104 with a hammer, which may produce an impulse which, according to Fourier, may contain substantially all frequencies.

All-thread rebar may be easily end-coupled to another piece of similar rebar using an internally-threaded connector, such as a "standoff." If the two rebar ends are joined securely, a long length of rebar may be made up of smaller subsections of manageable length, which may be easy to transport, store, and/or handle.

Figure 1B:
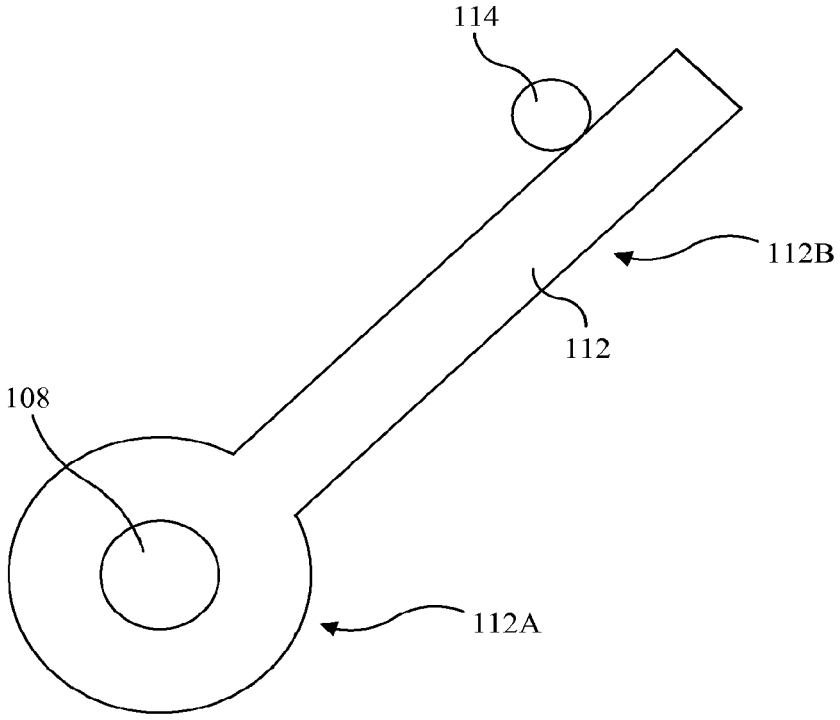
FIG. 1B is an elevation view of an example external wrench.

FIG. 1B is an elevation view of an example external wrench 112, arranged in accordance with at least some embodiments of the present disclosure. As depicted, external wrench 112 may be mounted to second end 108 of rebar 104. An example external wrench 112 may include a first end 112A configured to engage second end 108 of rebar 104, such as by being welded to rebar 104. A second end 112B may extend generally radially from rebar 104 and/or may be configured for application of torque to rebar 104. A stop 114 may be installed to prevent rotation of external wrench 112 relative to hardened concrete body 102, such as after threaded rebar 104 has been torsionally deformed and/or when it is desired to maintain such torsional deformation. Stop 114 may include, for example, a removable pin and/or other similar component configured to oppose rotation of external wrench 112. Any component that maintains rotation of rebar and/or otherwise maintains torque on a rebar (e.g., stop 114) may be referred to herein as a lock.

Figure 2:
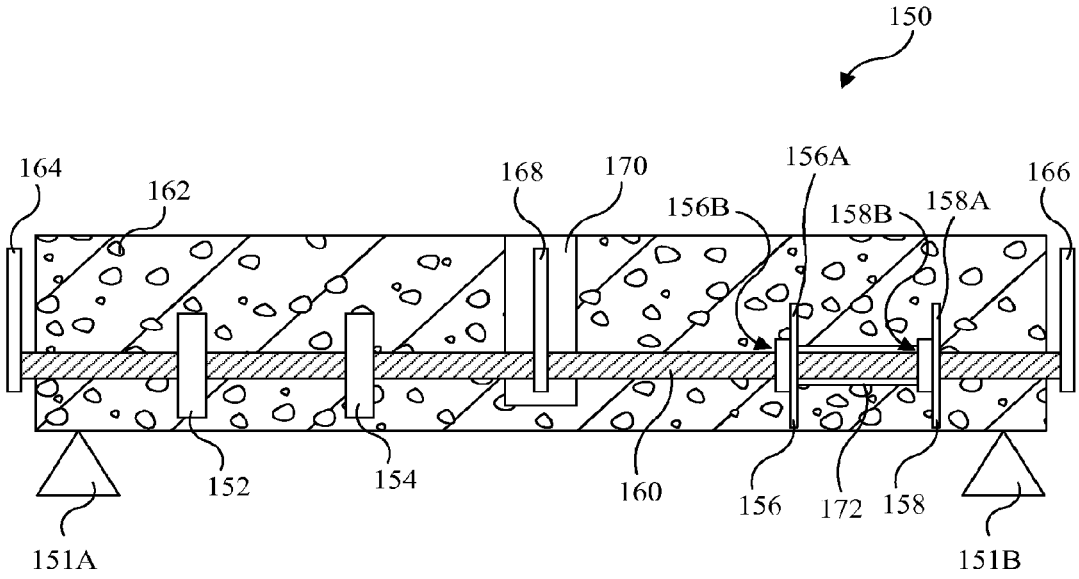
FIG. 2 is a cross-sectional view of an example prestressed concrete beam.

FIG. 2 is a cross-sectional view of an example prestressed concrete beam 150, arranged in accordance with at least some embodiments of the present disclosure. As depicted, beam 150 may be supported by supports 151A, 151B. Beam 150 may include a multiple number of internally threaded nuts 152, 154, 156, 158 which may be engaged with threaded rebar 160. Rebar 160 may extend at least partway through hardened concrete body 162. External wrenches 164, 166 may engage portions of rebar 160 extending beyond hardened concrete body 162. Internal wrench 168 may engage rebar 160 in a pit 170 provided in hardened concrete body 162. Pit 170 may be at least partially filled with concrete once access to internal wrench 168 is no longer desired. Some example embodiments may include a sleeve 172 interposing at least a portion of rebar and concrete body 162.

Example embodiments including internally threaded nuts 152, 154, 156, 158 engaged with threaded rebar 160 may reduce friction caused by concrete in contact with rebar 160, particularly where concrete 162 may adhere to rebar 160. In addition, internally threaded nuts 152, 154, 156, 158 may be useful where cast concrete internal threads engaged with threaded rebar 160 may be insufficiently strong for the desired application. One or more internally threaded nuts 152, 154, 156, 158 may be spaced along rebar 160 and/or may be arranged so that rebar 160 exerts forces predominantly on the nuts 152, 154, 156, 158, which may then apply forces to the concrete in which they are embedded. In some example embodiments, individual nuts 152, 154, 156, 158 may include a multiple number of separable components which may be assembled over rebar 160 and then locked together, which may avoid tedious threading of nuts onto long lengths of rebar 160. For example, an individual nut 152, 154, 156, 158 may include two generally semi-cylindrical sections which may be placed on rebar 160 and/or locked together to provide an internally threaded hole engaged with the external threads of rebar 160. Some example embodiments may include one or more sleeves 172 which may prevent concrete from adhering to the threads of rebar 160. For example, sleeve 172 may be generally tubular and/or may be configured to substantially cover at least a portion of rebar 160. Sleeves 172 may be constructed from any appropriate material, such as plastic, metal, etc.

In some example embodiments, individual nuts 156, 158 may include a plate 156A, 158A embedded in concrete body 162. An individual plate 156A, 158A may be provided with an internally threaded section 156B, 158B for threadedly engaging rebar 160. Internally threaded sections 156B, 158B may be bonded to respective plates 156A, 158A, such as by welding.

Figure 3:
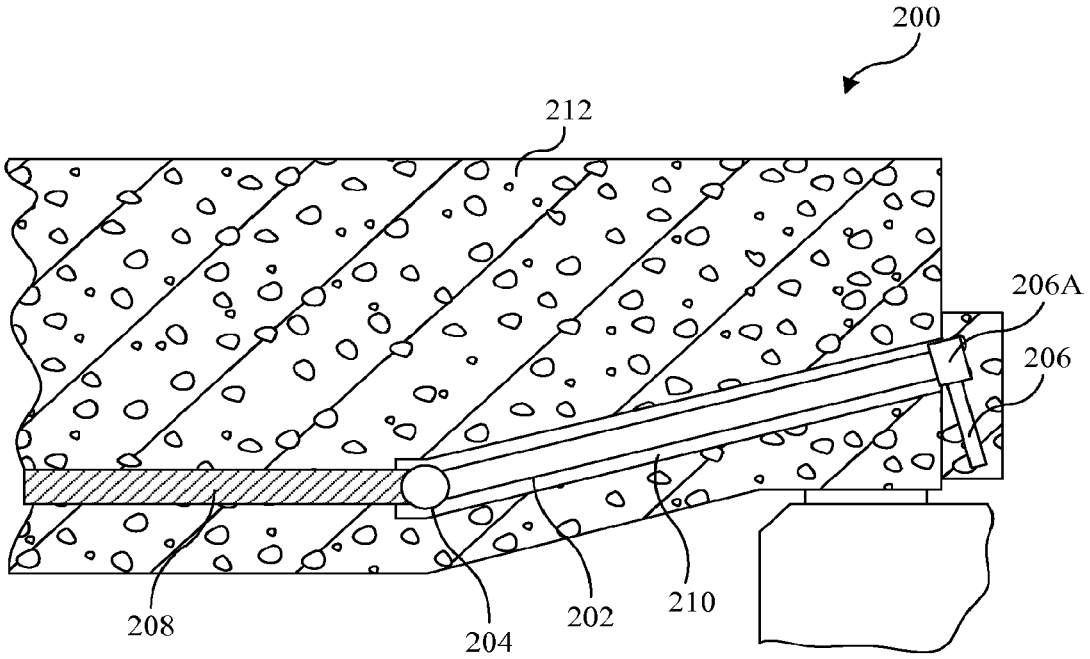
FIG. 3 is a cross-sectional view of an example prestressed concrete beam.

FIG. 3 is a cross-sectional view of an example prestressed concrete beam 200, arranged in accordance with at least some embodiments of the present disclosure. As depicted, concrete beam 200 may include an extension rod 202 and/or a universal joint 204 operatively coupling an external wrench 206 (which may include a ratchet 206A) to a threaded rebar 208 embedded within concrete beam 200. Extension rod 202 may extend within a channel 210 provided in hardened concrete body 212. In some example embodiments, extension rod 202 may be oriented other than linearly arranged (e.g., disposed at a non-zero angle) with respect to threaded rebar 208. In some such embodiments, universal joint 204 may allow rotational movement of extension rod 202 to cause rotational movement and/or torsional deformation of threaded rebar 208. Universal joint 204 may be provided within a housing and/or covering, which may prevent concrete from entering universal joint 204.

The present disclosure contemplates that torque may be transmitted from extension rod 202 to threaded rebar 208 without substantial loss because the torque-transmission factor may be the cosine of the angle between extension rod 202 and threaded rebar 208. Because the bending stresses on a beam suspended at its two ends may be greatest in the middle of its length, and because the stiffness of a beam (e.g., its moment of inertia) may be proportional to the square of the depth, beams may be made thicker in the middle, as shown in FIG. 3. The lower and middle portion of a beam may be where the compressive stress of the rebar may be particularly useful for resisting a load applied on the upper side of the beam.

The present disclosure contemplates that rebar may be made of fiber-reinforced resin instead of steel. Such rebar may be used in connection with example embodiments described herein. If the fibers run longitudinally through the rebar, then the rebar may be more resistant to stretching than it is to twisting. Larger diameters of rebar may be useful for uniform-pitch rebar, by the analysis above. In some example embodiments, fiber-reinforced rebar may include fibers that are wound generally helically inside the rebar so as to adjust the ratio of resistance to stretching as compared to resistance to twisting (that is, a ratio of moduli).

As shown in FIG. 3, in some example embodiments, an external wrench 206 may be covered with concrete after torque is applied, which may prevent corrosion and/or accidental loosening of the rebar. In some example embodiments, an external wrench 206 may include a ratchet 206A and/or equivalent mechanism to keep the rebar strained in torsion.

In some example embodiments, one and/or both ends of a rebar may extend beyond a hardened concrete body. Some example embodiments may include internal wrenches at locations other than ends of the rebar. See, for example, FIG. 2 which illustrates an internal wrench 168 provided generally near the midpoint of a rebar 160.

Figure 4A:
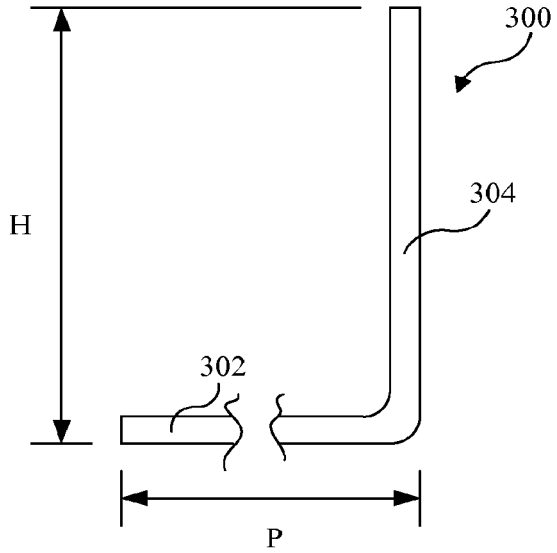
FIG. 4A is an end view of an example channel.
Figure 5:
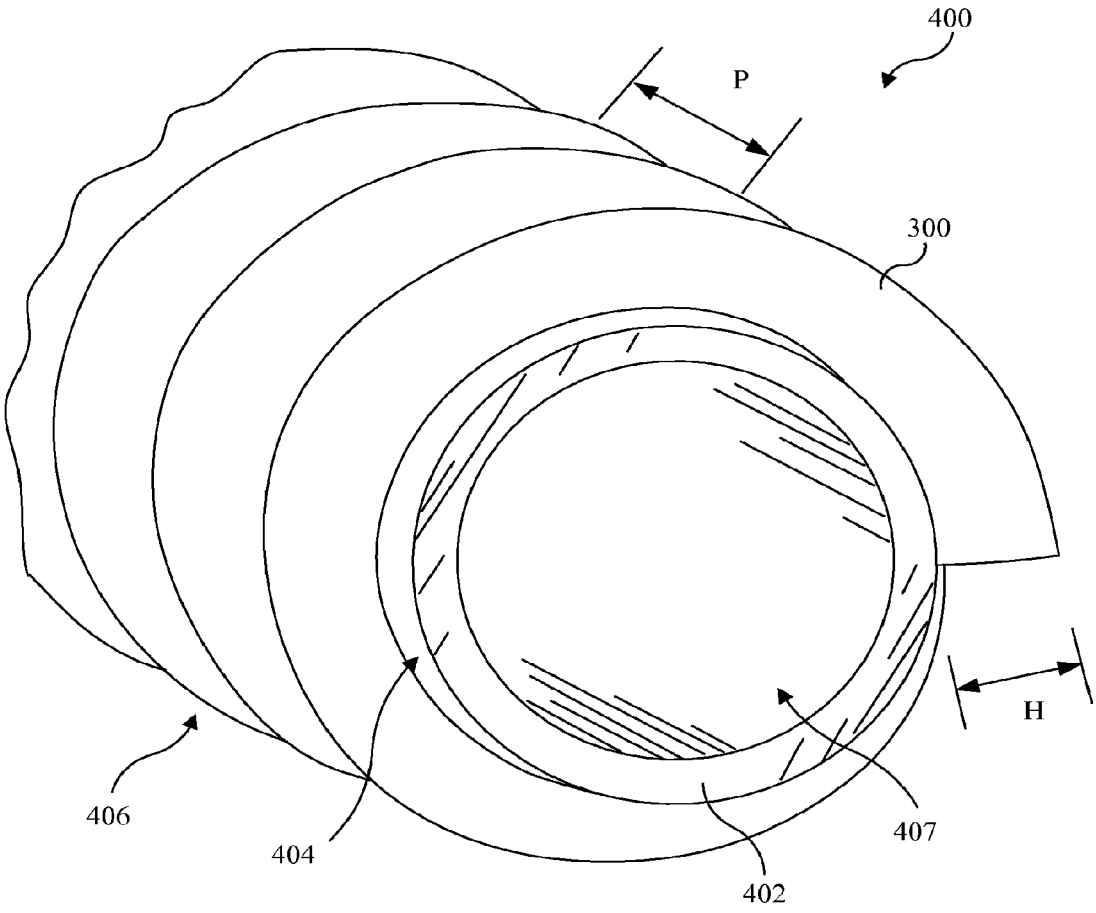
FIG. 5 is a perspective view of an example threaded rebar.

FIG. 4A is an end view of an example channel 300, arranged in accordance with at least some embodiments of the present disclosure. As shown in FIG. 5 (discussed below), channel 300 may be wrapped around a generally cylindrical rod in a generally helical fashion to provide an externally threaded rebar. Channel 300 may have a substantially nonlinear cross section, such as a generally L-shaped cross section, which may include a base portion 302 and/or an upstanding portion 304, where base portion 302 and upstanding portion 304 may be disposed at about 90 degrees with respect to each other. The width of base portion 302 may correspond to the pitch P of the threads formed when channel 300 is wrapped around the generally cylindrical rod (see, e.g., FIG. 5). The height H of channel 300 may correspond to the height of the threads formed when channel 300 is wrapped around the generally cylindrical rod (see, e.g., FIG. 5).

Figure 4C:
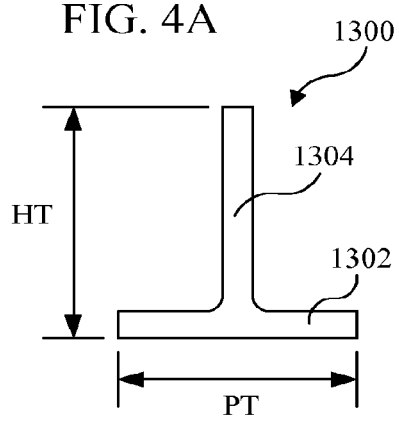
FIG. 4C is an end view of an alternative example channel.
Figure 4D:
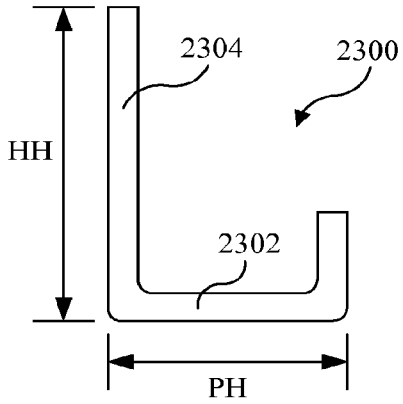
FIG. 4D is an end view of an alternative example channel.
Figure 4B:
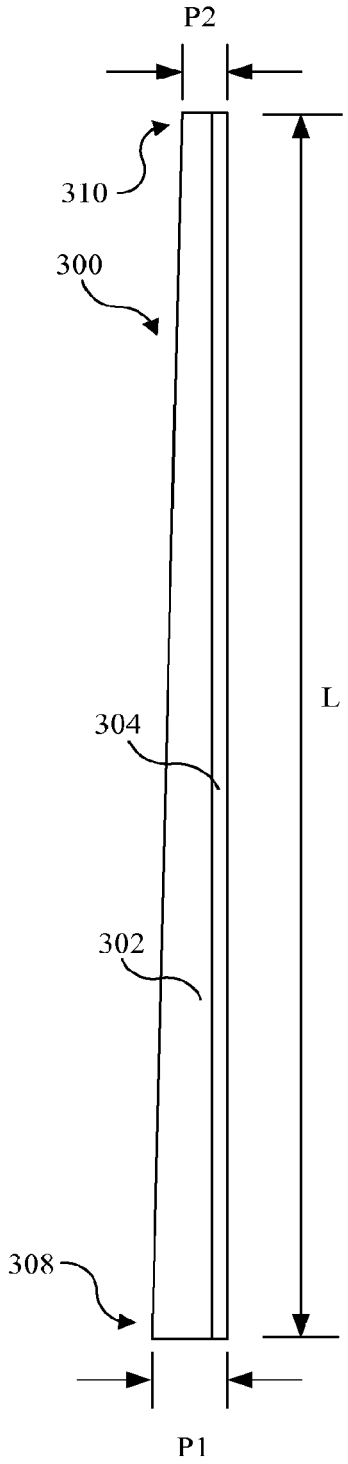
FIG. 4B is a plan view of an example channel.

FIG. 4B is a plan view of example channel 300, arranged in accordance with at least some embodiments of the present disclosure. In some example embodiments, the width of base portion 302 may vary over the length L of channel 300. For example, at a first end 308 of channel 300, base portion 302 may have a width providing a first thread pitch P1 when channel 300 is wrapped in a generally helical fashion around the generally cylindrical rod (see, e.g., FIG. 5). At a second end 310, base portion 302 may have a width providing a second thread pitch P2 when channel 300 is wrapped in a generally helical fashion around the generally cylindrical rod (see, e.g., FIG. 5). In some example embodiments, height H of channel 300 may vary along length L of channel 300.

FIG. 4C is an end view of an alternative example channel 1300, arranged in accordance with at least some embodiments of the present disclosure. Channel 1300 may be wrapped around a generally cylindrical rod in a generally helical fashion as mentioned above regarding channel 300. Channel 1300 may have a substantially nonlinear cross section, such as a generally T-shaped cross section, which may include a base portion 1302 and/or an upstanding portion 1304, where base portion 1302 and upstanding portion 1304 may be disposed at about 90 degrees with respect to each other. The width of base portion 1302 may correspond to the pitch PT of the threads formed when channel 1300 is wrapped around the generally cylindrical rod. The height HT of channel 1300 may correspond to the height of the threads formed when channel 1300 is wrapped around the generally cylindrical rod.

FIG. 4D is an end view of an alternative example channel 2300, arranged in accordance with at least some embodiments of the present disclosure. Channel 2300 may be wrapped around a generally cylindrical rod in a generally helical fashion as mentioned above regarding channel 300. Channel 2300 may have a substantially nonlinear cross section, such as a generally hook-shaped cross section, which may include a base portion 2302 and/or an upstanding portion 2304, where base portion 2302 and upstanding portion 2304 may be disposed at about 90 degrees with respect to each other. The width of base portion 2302 may correspond to the pitch PH of the threads formed when channel 2300 is wrapped around the generally cylindrical rod. The height HH of channel 2300 may correspond to the height of the threads formed when channel 2300 is wrapped around the generally cylindrical rod.

FIG. 5 is a perspective view of an example threaded rebar 400, arranged in accordance with at least some embodiments of the present disclosure. As depicted, threaded rebar 400 includes a channel 300 wrapped in a generally helical fashion around a generally cylindrical rod 402. Generally cylindrical rod 402 may be hollow with an axial channel 407 and/or may include a radial surface 404, which may receive base portion 302 of channel 300. Channel 300 may form an external thread 406 having a height H and/or a pitch P.

In some example embodiments, channel 300 and generally cylindrical rod 402 may be constructed from the same and/or complementary materials. For example, channel 300 and generally cylindrical rod 402 may be constructed of resin and/or steel. In some example embodiments, channel 300 and/or generally cylindrical rod 402 may be welded to fasten channel 300 wrapped around generally cylindrical rod 402.

Channel 300 may be wrapped in a generally helical fashion such that each turn of channel 300 around generally cylindrical rod 402 substantially abuts the previous turn. In other words, base portion 302 of one turn may substantially lie against base portion 302 of the previous turn, and so on. In embodiments including a tapered base portion 302 (see, e.g., FIG. 4B), such an arrangement may produce an external thread 406 having a pitch P that varies substantially uniformly along the length of the rebar.

The present disclosure contemplates that threaded rebar 400 including an external thread 406 having a gradually varying pitch may be useful, particularly where it may be difficult to torsionally deform a large-diameter rebar sufficiently to obtain the desired compression. In some example embodiments incorporating thread of a varying pitch, the rebar may not need to deform in torsion to apply the desired compressive forces to the concrete. If the thread pitch changes generally linearly with distance along the rebar, then rotation may exert a generally uniform compressive force on the concrete. As with the constant-pitch threaded rebar, varying pitch threaded rebar may be kept from adhering to the surrounding concrete with small to-and-fro rotations during cure.

The present disclosure contemplates that, in a variable pitch threaded rebar, if the variation in pitch is not a uniform function of the length of the rebar, then different amounts of compression may be applied to different regions of the concrete along the length of the rebar, which may be useful in some designs. For example, in a beam that is loaded on its upper side, the requirement for compressive stress may be greatest in the middle, and a rebar's thread pitch may be chosen so that the stress is greater toward the middle of the beam and is less toward the ends.

In some example embodiments, threaded rebar 400 including a variable pitch external thread 406 may be constructed by wrapping channel 300 around generally cylindrical rod 402 such that base portions 302 of consecutive turns do not always abut each other. As will be understood by those of skill in the art, spacing between consecutive turns of channel 300 may determine the pitch P of thread 406. In some example embodiments, channel 300 may have cross sections other than an L-shape. For example, in some alternative embodiments, channel 300 may have a generally T-shaped cross section.

In some example embodiments, channel 300 may be coiled such that abutting turns exert a compressive force on each other. In some such embodiments, abutting turns may have substantially no axial distance between each other, and it may be necessary to exert an axially tensile force to pull abutting turns apart. Such a configuration may be advantageous because it may increase the precision of the thread spacing.

Although FIG. 5 illustrates a hollow generally cylindrical rod 402 including an axial channel 407, generally, cylindrical rod may be at least partially solid or may be substantially completely solid. The present disclosure contemplates that the hollow generally cylindrical rod 402 may be stiffer than a solid generally cylindrical rod 402 comprising the same amount of steel.

Figure 6:
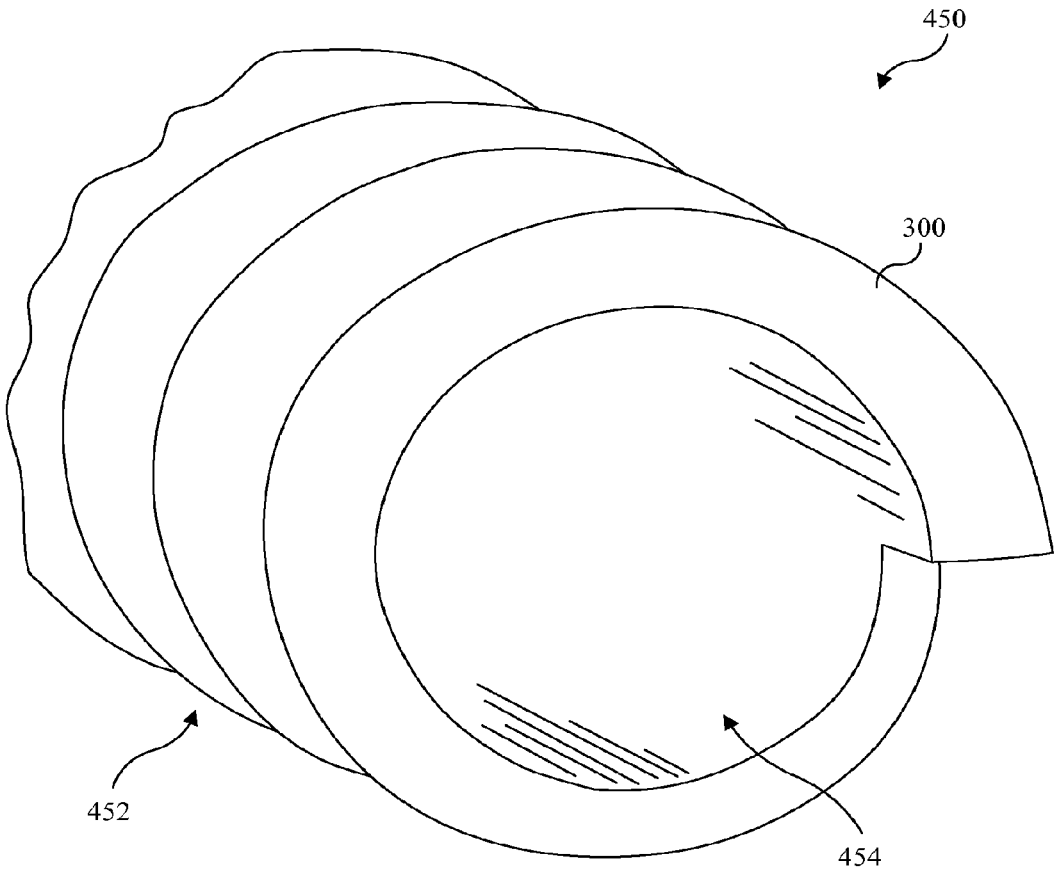
FIG. 6 is a perspective view of an example rebar.

FIG. 6 is a perspective view of an example rebar 450, arranged in accordance with at least some embodiments of the present disclosure. As depicted, rebar 450 may include a generally helically coiled channel 300 forming an external thread 452 and/or a hollow interior 454. Rebar 450 may not include the generally cylindrical rod 402 (FIG. 4). In some such embodiments, generally cylindrical rod 402 may be used to form channel 300 into its generally helical shape, but may be removed prior to installing the resulting rebar into a beam.

Figure 7:
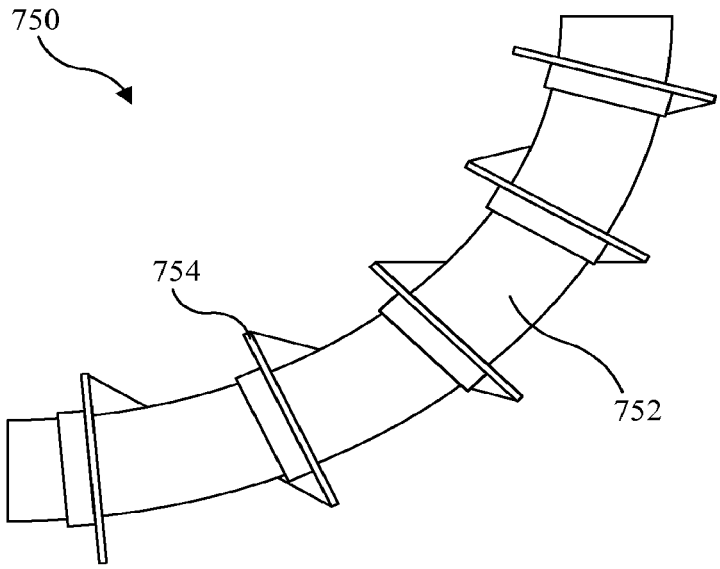
FIG. 7 is a plan view of an example curved rebar.

In some example embodiments, a curved rod or pipe may be the basis for a curved rebar of small radius, using a channel similar to those described above. FIG. 7 is a plan view of an example curved rebar 750, arranged in accordance with at least some embodiments of the present disclosure. As depicted, curved rebar 750 may include a curved core 752 about which a channel 754 may be wrapped in a generally helical fashion. In some example embodiments, channel 754 may be wrapped around but may not be fastened to the curved core 752. Channel 754 may be allowed to slide on the external surface of the curved core 752 and/or may be lubricated for that purpose. If channel 754 is rotated about the curved core 752, the channel 754 may tend to spread generally axially, which may exert a compressive force on surrounding concrete, which may follow the line of curved core 752. Such a method might be used to reinforce an arch of small radius. (An arch of larger radius can be reinforced by straight segments joined by universal joints.)

Figure 8:
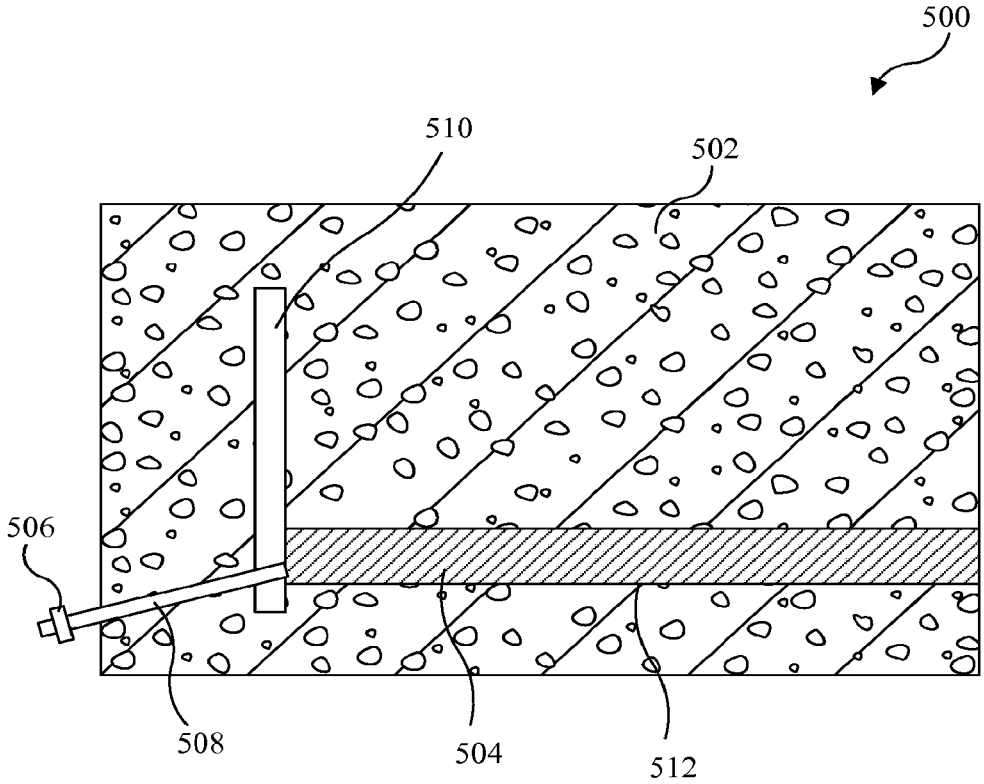
FIG. 8 is a cross-sectional view of an example beam.

Some example embodiments may be configured for flushing lubricant interposing rebar 504 and hardened concrete body 502. FIG. 8 is a cross-sectional view of an example beam 500, arranged in accordance with at least some embodiments of the present disclosure. As depicted, beam 500 may include a hardened concrete body 502 and/or a threaded rebar 504. A grease nipple 506 may be fluidicly coupled to the exterior of threaded rebar 504 by a grease conduit 508. Grease conduit 508 may join the exterior of threaded rebar 504 proximate an internal wrench 510. A lubricant 512 may at least partially interpose threaded rebar 504 and hardened concrete body 502.

The present disclosure contemplates that it may be beneficial to replace lubricant 512 between rebar 504 and concrete body 502. Over time, lubricant 512 may degrade and/or change its pH, which may leave steel rebar 504 vulnerable to corrosion, attack by microorganisms, or other degradation. In some example embodiments, replacement lubricant may be slowly pumped through the gap between rebar 504 and concrete 502. This operation may be accomplished by something as simple as periodically applying a grease gun to grease nipple 506, which may be fluidicly coupled to the exterior of rebar 504. An air space, perhaps built into the handle of internal wrench 510 (and/or provided by cavity 110A of FIG. 1A), may be used to maintain pressure while injected lubricant slowly moves along the thread and extrudes at the other end. Periodically replacing the lubricant may maintain surface coverage, decrease pH changes, and/or flush out microorganisms.

Some example embodiments according to the present disclosure may provide advantages over cable reinforcement systems. For example, because solid rebar may have a modulus of elasticity of about three times that of a cable of the same diameter, solid rebar may more effectively prevent collapse.

Figure 9:
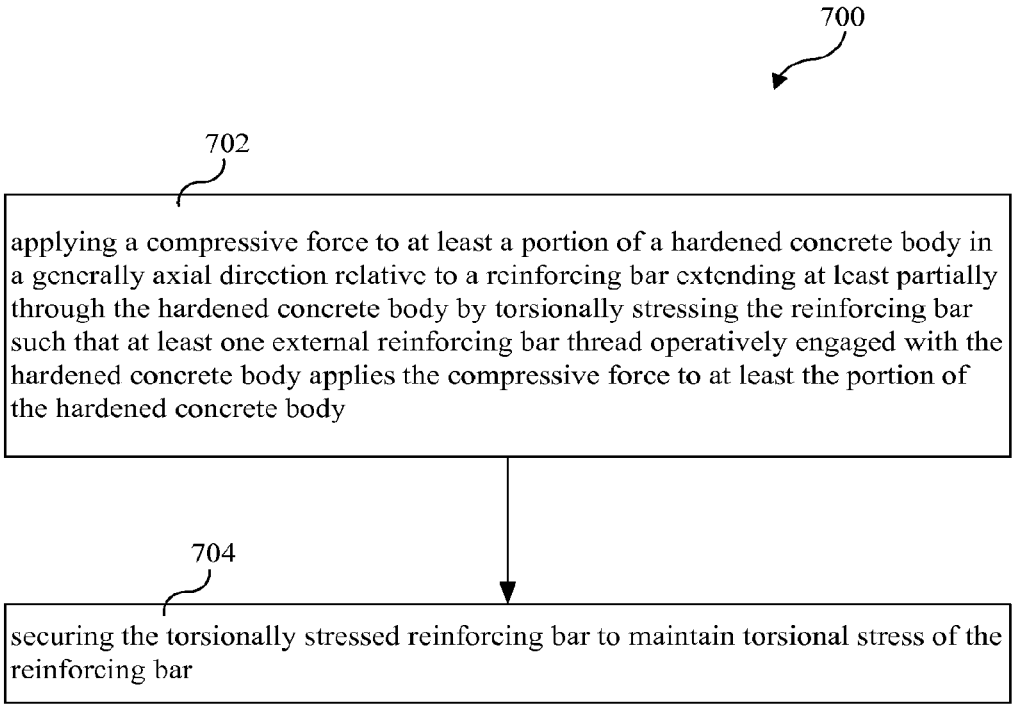
FIG. 9 is a flow chart illustrating an example method for constructing a prestressed concrete structure; all arranged in accordance with at least some embodiments of the present disclosure.

FIG. 9 is a flow chart illustrating an example method 700 for constructing a prestressed concrete structure, arranged in accordance with at least some embodiments of the present disclosure. Method 700 may include operation 702, which may include applying a compressive force to at least a portion of a hardened concrete body in a generally axial direction relative to a reinforcing bar extending at least partially through the hardened concrete body by torsionally stressing the reinforcing bar such that at least one external reinforcing bar thread operatively engaged with the hardened concrete body applies the compressive force to at least the portion of the hardened concrete body. Operation 704 may follow operation 702 and may include securing the torsionally stressed reinforcing bar to maintain torsional stress of the reinforcing bar.

The herein described subject matter sometimes illustrates different components contained within, or connected with, different other components. It is to be understood that such depicted architectures are merely examples, and that in fact many other architectures may be implemented which achieve the same functionality. In a conceptual sense, any arrangement of components to achieve the same functionality is effectively "associated" such that the desired functionality is achieved. Hence, any two components herein combined to achieve a particular functionality may be seen as "associated with" each other such that the desired functionality is achieved, irrespective of architectures or intermedial components. Likewise, any two components so associated may also be viewed as being "operably connected", or "operably coupled", to each other to achieve the desired functionality, and any two components capable of being so associated may also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art may translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A prestressed concrete structure comprising:

a hardened concrete body;

a reinforcing bar comprising a first end and a second end, at least a portion of the reinforcing bar between the first end and the second end extending at least partially through the hardened concrete body;

at least one external thread disposed on the reinforcing bar, the external thread formed from an elongated, nonlinear channel wrapped about a radial surface of the reinforcing bar in a substantially helical fashion, wherein a base portion of the nonlinear channel is disposed substantially against the radial surface of the reinforcing bar and an upstanding portion of the nonlinear channel extends generally orthogonally from the radial surface of the reinforcing bar, and wherein the base portion of the nonlinear channel increases in width along the generally cylindrical rod from the first end to the second end, the at least one external thread operatively engaged with the hardened concrete body;

a first lock operatively coupled to a first locked section of the reinforcing bar adjacent to the first end, the first lock being arranged to oppose rotation of the first locked section of the reinforcing bar relative to the hardened concrete body, wherein the first lock is configured to maintain the reinforcing bar in a torsionally stressed condition employing one of: a wrench or a ratchet, such that the at least one external thread maintains a compressive force on the hardened concrete body in a generally axial direction relative to the reinforcing bar; and at least one plate having an internally threaded hole, wherein the plate is embedded in the hardened concrete body and engaged via the internally threaded hole with the at least one external thread of the reinforcing bar such that the at least one external thread maintains axial forces on the plate and the plate maintains compressive forces to the hardened concrete body.

2. The prestressed concrete structure of claim 1, further comprising a lubricant radially interposing at least a portion of the threaded section and at least a portion of the hardened concrete body.

3. The prestressed concrete structure of claim 1, further comprising:

a second lock operatively coupled to a second locked section of the reinforcing bar adjacent to the second end, the second lock being arranged to oppose rotation of the second locked section of the reinforcing bar relative to the hardened concrete body.

4. The prestressed concrete structure of claim 1, wherein the at least one external thread has a varying pitch over at least a portion of the threaded section.

5. The prestressed concrete structure of claim 1, further comprising a plurality of axially spaced-apart, internally threaded nuts embedded in the hardened concrete body and engaged via the internal threads of the nuts with the at least one external thread of the reinforcing bar, wherein the at least one external thread maintains axial forces on the nuts and the nuts maintain compressive forces to the hardened concrete body.

6. The prestressed concrete structure of claim 1, wherein the first lock is embedded within the hardened concrete body.

7. A method of constructing a prestressed concrete structure, the method comprising:

disposing a reinforcing bar within a hardened concrete body, the reinforcing bar including a first end and a second end, wherein at least a portion of the reinforcing bar between the first end and the second end extends at least partially through the hardened concrete body;

forming at least one external thread on an external surface of the reinforcing bar, the external thread formed from an elongated, nonlinear channel wrapped about a radial surface of the reinforcing bar in a substantially helical fashion, wherein a base portion of the nonlinear channel is disposed substantially against the radial surface of the reinforcing bar and an upstanding portion of the nonlinear channel extends generally orthogonally from the radial surface of the reinforcing bar, and wherein the base portion of the nonlinear channel increases in width along the generally cylindrical rod from the first end to the second end, the at least one external thread operatively engaged with the hardened concrete body;

embedding at least one plate having an internally threaded hole in the hardened concrete body, wherein the plate is engaged via the internally threaded hole with the at least one external thread of the reinforcing bar such that the at least one external thread maintains axial forces on the plate and the plate maintains compressive forces to the hardened concrete body; and coupling a first lock to the first end of the reinforcing bar, the first lock configured to oppose rotation of the first locked section of the reinforcing bar relative to the hardened concrete body, wherein the first lock is configured to maintain the reinforcing bar in a torsionally stressed condition employing one of: a wrench or a ratchet, such that the at least one external thread maintains a compressive force on the hardened concrete body in a generally axial direction relative to the reinforcing bar.

8. The method of claim 7, further comprising radially interposing a lubricant radially on at least a portion of the at least one external thread and at least a portion of the hardened concrete body.

9. The method of claim 7, further comprising coupling a second lock to the second end of the reinforcing bar, the second lock configured to oppose rotation of the second locked section of the reinforcing bar relative to the hardened concrete body.

10. The method of claim 7, wherein the at least one external thread has a varying pitch over at least a portion of the threaded section.

11. The method of claim 7, further comprising: embedding a plurality of axially spaced-apart, internally threaded nuts within the hardened concrete body, and engaging the internally threaded nuts with the at least one external thread of the reinforcing bar, wherein the at least one external thread maintains axial forces on the nuts and the nuts maintain compressive forces to the hardened concrete body.

* * * * *

UNITED STATES PATENT AND TRADEMARK OFFICE

CERTIFICATE OF CORRECTION

PATENT NO. : 8,534,022 B2
APPLICATION NO. : 13/139328
DATED : September 17, 2013
INVENTOR(S) : Bromer It is certified that error appears in the above-identified patent and that said Letters Patent is hereby corrected as shown below:

On Title Page 2, Item "(56)", References Cited under "OTHER PUBLICATIONS", in Column 1, Lines 5-6, delete "http://www.wiliiamsform.com/Threaded Bars/Grade 75 AllThread_Rebar/grade_75_all-,thread_rebar.html" and insert -- http://www.williamsform.com/Threaded_Bars/Grade_75_AllThread_Rebar/grade_75_all-,thread_rebar.html --, therefor.

On Title Page 2, Item "(56)", References Cited under "OTHER PUBLICATIONS", in Column 2, Line 8, delete "al," and insert -- al., --, therefor.

In the Specification

In Column 1, Line 4, delete "APPLICATIONS" and insert -- APPLICATION --, therefor.

In Column 8, Line 51, delete "that is inch" and insert -- that is ¾ inch --, therefor.

In Column 13, Line 31, delete "fluidicly" and insert -- fluidically --, therefor.

In Column 13, Line 46, delete "fluidicly" and insert -- fluidically --, therefor.

Signed and Sealed this
Eighteenth Day of March, 2014

Michelle K. Lee

Michelle K. Lee
*Deputy Director of the United States Patent and Trademark Office*